United States Patent [19]

Yamane et al.

[11] Patent Number: 4,919,977

[45] Date of Patent: Apr. 24, 1990

[54] COATING METHOD

[75] Inventors: Takakazu Yamane; Yoshio Tanimoto; Tadamitsu Nakahama; Makoto Aizawa; Tsuneo Kishimoto, all of Hiroshima, Japan

[73] Assignee: Mazda Motor Corporation, Hiroshima, Japan

[21] Appl. No.: 323,237

[22] Filed: Mar. 15, 1989

Related U.S. Application Data

[63] Continuation of Ser. No. 153,669, Feb. 8, 1988, abandoned.

[30] Foreign Application Priority Data

| | | | |
|---|---|---|---|
| Feb. 10, 1987 | [JP] | Japan | 62-27390 |
| Feb. 10, 1987 | [JP] | Japan | 62-27392 |
| Feb. 10, 1987 | [JP] | Japan | 62-27393 |
| Feb. 13, 1987 | [JP] | Japan | 62-29873 |
| Apr. 1, 1987 | [JP] | Japan | 62-77528 |

[51] Int. Cl.[5] ..... B05D 3/02

[52] U.S. Cl. ..... 427/379; 427/388.1; 427/409; 427/425

[58] Field of Search ..... 427/388.1, 407.1, 409, 427/410, 379, 425

[56] References Cited

U.S. PATENT DOCUMENTS

| | | | |
|---|---|---|---|
| 4,702,968 | 10/1987 | Masuhara et al. | 427/409 X |
| 4,731,290 | 3/1988 | Chang | 427/409 X |
| 4,741,932 | 5/1988 | Ichimura et al. | 427/409 X |

FOREIGN PATENT DOCUMENTS

| | | |
|---|---|---|
| 3346763 | 7/1984 | Fed. Rep. of Germany . |
| 3520924 | 12/1985 | Fed. Rep. of Germany . |
| 104816 | 3/1974 | German Democratic Rep. . |
| 2171030 | 8/1986 | United Kingdom . |

OTHER PUBLICATIONS

European Search Report dated Dec. 22, 1987.
Japanese Utility Model Publication No. 2228/1976.
Japanese Patent Publication No. 30,581/1982.
Japanese Utility Model Publication No. 80,390/1983.
Japanese Utility Model Publication No. 109,430/1984.
Japanese Utility Model Publication No. 21,361/1985.
Japanese Patent Publication No. 4,471/1984.
Japanese Utility Model Publication No. 20053/1981.

*Primary Examiner*—Michael Lusignan
*Attorney, Agent, or Firm*—Wegner & Bretschneider

[57] ABSTRACT

The coating method includes the intercoating step for spraying the intercoating paint over a substrate after undercoating, the intercoat drying step for drying the intercoat on the substrate, the overcoating step for spraying the overcoating paint over the dried intercoat on the substrate, and the overcoat drying step for drying the overcoat. In the intercoating step, the intercoating paint is sprayed in such an amount as causing sag, that is, in an amount beyond its sagging threshold value. In the intercoat drying step, the substrate is rotated about its horizontal and longitudinal axis to dry the intercoat.

59 Claims, 13 Drawing Sheets

COATING METHOD

This application is a continuation of U.S. application Ser. No. 153,669, filed Feb. 8, 1988, now abandoned.

BACKGROUND OF THE INVENTION

1. Field of the Invention

The present invention relates to a coating method.

2. Description of Related Art

Coating method of outer surfaces of substrates such as vehicle bodies generally includes steps of coating the substrates and drying coats thereon. The drying step may be divided further into a setting step and a baking step. The setting step is usually carried out in ambient atmosphere or at temperatures of 40° to 60° C. prior to the baking step. The temperature used for the setting step is lower than that for the baking step that is usually carried out at temperatures of approximately 140° C. The setting step may be referred to sometimes as temporary baking.

In many cases coating on substrates may be effected at three steps: undercoating, intercoating and overcoating. Each coating comprises steps of providing a coat on a substrate and drying the coat thereon. An undercoat layer is usually formed on the substrate by means of dipping, while intercoat (intermediate coat) and overcoat (top coat) layers are generally formed by spraying. The paints used for each coating have their own functions: undercoating paints are used to ensure a resistance to corrosion, intercoating paints are to adjust a roughness of the undercoat and to provide an anti-chipping capability, and overcoating is to cover the intercoat. A total thickness of the three coat layers are generally in the range from 85 to 115 μm: a thickness of the undercoat layer being usually in the range from 15 to 25 μm; a thickness of the intercoat layer in the range from 35 to 45 μm; and a thickness of the overcoat layer in the range from 35 to 45 μm.

Overcoating paints are extremely expensive compared with undercoating and intercoating paints so that it is desirable to allow a possibly thinner overcoating while an intercoat layer is rendered as thicker as possible in order to maintain a total thickness of all three coats to conventional thicknesses.

As the overcoat would be made thinner, a color of the intercoat can be seen through the overcoat layer. This may be solved by using the intercoat having a color identical to or very similar to that of the overcoat layer, that is, by effecting the color intercoating.

A limit exists, however, to the thickness of the intercoat layer because a thicker intercoat layer is likely to become roughened as if it is welted to a great extent. Such roughness on the intercoat layer offers the problem with evenness of an overcoat layer formed thereon. This roughness cannot be substantially restored by a wet rubbing treatment that is usually carried out after the drying of the intercoating.

As one standard for evaluating the quality of a coat surface is a degree of evenness. The larger the degree of evenness becomes, the smaller irregularities or roughness on the coat surface. Accordingly, a coat having a larger degree of evenness may be determined as a better coat. It is known that such a degree of evenness on a coat may be improved as the coat is made thicker.

As a paint is coated on the surface of a coating substrate, it may be caused to sag or drop downwardly along the substrate surface due to gravity. The paint may be likely to sag when a large amount of the paint is coated. This sagging phenomenon is a factor of adversely affecting a quality of the coated surface.

The sag may be caused to occur due to the force of gravity so that it may occur on a vertical surface of the substrate. Accordingly, the sagging does not usually offer the problem when a large amount of a paint is coated on a transverse surface of the substrate. This results in the fact that a coat thickness of the transverse substrate surface can be rendered thicker than that of the vertical substrate surface. If a paint would be coated on the transverse surface of the substrate to form a coat as thick as a coat formed on the vertical surface thereof in such an amount as causing no sag on the transverse surface thereof, the paint coated on the transverse surface will be evened due to some extent of its natural flow whereby the coat having a higher degree of evenness is provided on the transverse surface than on the vertical surface.

From the above point of view, conventional spraying procedures have taken the measures to prevent a paint from sagging by using a paint having a viscosity or flowability as low as possible in order to provide a coat surface with a high degree of evenness. For conventional overcoating paints such as thermosetting paints, a sagging threshold value is approximately 40 μm at the maximum. The sagging threshold value is defined herein by the maximum thickness of a coated paint that cause no sags on the vertical surface of a substrate. Sagging of a paint is most likely to occur at the initial stages of the setting and baking steps and in particular at the initial stage of the baking step so that a thickness of a paint to be coated on a vertical substrate surface during the coating step is determined by the thickness of the coat that causes no sagging thereon at this stage, that is, by the sagging threshold value. In order to provide a coat layer with a higher degree of evenness, the conventional techniques require the paint to be coated plural times such as twice by repeating a series of the steps from the coating step to the baking step.

For coating procedures requiring intercoating and overcoating steps, a degree of evenness of an intercoat layer exert a great experience on evenness or flatness on an overcoat layer to be coated thereon. As a limit exists in the conventional procedures, however, to improvement in a degree of evenness on the overcoat layer, a wet rubbing treatment has been carried out over the intercoat layer after the intercoat drying step in order to improve a degree of evenness on the intercoated layer.

The use of the wet rubbing treatment necessarily require additional steps: the step for subjecting the dried intercoat to wet rubbing and the step for drying the wet intercoat after the wet rubbing step. An increase in these steps is disadvantageous from the point of view of commercial production. The wet rubbing may exercise an adverse influence upon a quality of a finish overcoat layer to be coated thereon because portions of a coating surface might be remained wet due to the difficulty of thoroughly drying such a vehicle body as having a complex construction with a variety and number of open portions.

SUMMARY OF THE INVENTION

The present invention has one object to provide a coating method adapted to cover an intercoat layer formed on an undercoat with an overcoat without subjecting the intercoat to a wet rubbing treatment or in such a manner as reducing the wet rubbing work.

The present invention has another object to provide a coating method adapted to minimize a thickness of an overcoat, thereby reducing an amount of an expensive overcoat paint.

The present invention has a further object to provide a coating method adapted to produce an overcoat with a higher degree of evenness compared with another overcoat with the same film thickness.

In one aspect the present invention consists in a coating method which comprises the first step of spraying an intercoating paint over a surface of a substrate to form an intercoat layer thereon on which an undercoat has been layered, an amount of said intercoating paint to be sprayed at least on a vertical surface of the substrate being larger than such an amount thereof as causing said intercoating paint to sag; the second step of drying said intercoat layer while the substrate is being rotated about the horizontal axis therof; the third step of spraying an overcoating paint over said intercoat layer to form an overcoat layer after the second step; and the fourth step of drying said overcoat layer.

The coating method according to the present invention is designed such that the substrate on which the intercoating paint has been sprayed is rotated about the horizontal and longitudinal axis thereof for drying the intercoated paint whereby the force of gravity acting in the vertical direction on the intercoat formed on the vertical surface of the substrate is forced to be altered. The alteration of the direction of gravity prevents the intercoated paint from sagging during the drying step and the paint is dried without sagging even if the paint has been sprayed in an amount large enough to cause sagging. Thus the features of the coating method according to the present invention involve the spraying of the intercoating paint in an amount larger than a sagging threshold value, that is, in such an amount as causing the paint to sag, and the rotating the substrate on which the intercoating paint has been coated in the horizontal axis thereof. These features of the present invention provide an overcoat with a higher degree of evenness than an overcoat produced by conventional techniques if their intercoats were as thick as each other and at the same time permits an intercoat much thicker than conventional ones can.

Even if no wet rubbing is carried out, the coating method according to the present invention provides a dried intercoat layer with a degree of evenness higher than or as high as such a dried intercoat layer as have been produced by subjecting the intercoat layer to the wet rubbing treatment. Without the wet rubbing, this results in provision of a final overcoat with a degree of evenness higher than or as high as overcoats formed by conventional procedures requiring the wet rubbing treatment for the intercoat. Even if the wet rubbing is preferably employed, a workload for the wet rubbing treatment for providing a desired degree of evenness can be reduced to an extent less than that being otherwise required for the wet rubbing in the conventional procedures.

Furthermore, in instances where it is not necessary to provide a final overcoat surface with a very high degree of evenness, it is found advisable that an intercoat can be made as thick as possible and a degree of evenness on the intercoat surface is rendered as high as possible. This can help decrease an amount of the overcoated layer and reduce an amount of an overcoating paint to be used whereby painting costs are to be reduced because the overcoating paint is much expensive compared with the intercoating paint. If the intercoating paint having a color identical or extremely similar to the color of the overcoating paint is employed as in a so-called color intercoating, a thickness of the overcoat layer can be rendered extremely thin.

It is also to be noted that the coating method according to the present invention permits an overcoating paint to be coated by spraying the paint at least on the vertical surface of the vehicle body W to a thickness that the paint is caused to sag. In this case, the paint sprayed on the dried intercoat on the substrate is dried while being rotated about the horizontal axis thereof in the overcoat drying step. This procedure provides an overcoat surface with a higher degree of evenness compared with overcoats with identical thicknesses prepared by conventional procedures. In other words, the present invention can provide an overcoat with a high degree of evenness even if a thickness of the overcoat is made thinner. It is necessarily possible to improve a degree of evenness on an overcoat surface to a remarkably high extent if the overcoat is rendered thick.

In accordance with the present invention, it is found preferable to change a conveyer or carrier means, such as carriages, for conveying the substrate from one step to another. In other words, it is preferred that the substrate is transferred from a carriege on which it is loaded during the intercoating step to another carriage on which it is to be loaded during the intercoat drying step. The change of the carrier means can prevent dirts or other foreign materials from adhering onto the wet intercoat surface during the intercoat drying step because the intercoated substrate is rotated during the intercoating drying step while it is loaded on the carrier means. In particular, in instances where a paint adheres to a rotation mechanism mounted on the carrier means for rotating the substrate, it shows a growing tendency that it comes off or peels off as it become solidified particularly on rotating and sliding portions of the rotation mechanism of the carrier means. Scales or particles of the solidified paint peeled off from the carrier means suspend in air in the form of floating dust and they are likely to adhere to the wet intercoat surface of the substrate. This possibility can be prevented or reduced to a minimized level by transferring the intercoated substrate to a new carriage that has not been employed for spraying the substrate with the intercoating paint.

The change of the conveyance or carrier means is preferably made like the intercoat drying step in instances where the substrate with the overcoat is rotated during the overcoat drying step.

In order to prevent dust and other foreign materials from adhering to the coated surface, the substrate may be preferably rotated during a preparation step prior to the step of spraying the substrate with a paint to remove the dust and so on therefrom. The rotation of the substrate permits a sufficient removal of the dust and so on by causing them to fall down therefrom as the substrate is being made a turn.

It is furthermore preferred that the substrate is subjected to correction coating prior to the spraying of the intercoating paint. Although the substrate is sprayed with the intercoating paint by means of automatically spraying machines such as robots, there are some portions that remain irregular in spraying or incompletely painted. In conventional procedures, such irregularly and incompletely sprayed portions are subjected to correction coating by means of manual spraying. For the coating method according to the present invention, at least the intercoating paint is sprayed in an amount larger than a sagging threshold value at the intercoat spraying step so that the substrate should be conveyed to the intercoat drying step as soon as possible in order to prevent the paint from falling down therefrom. The provision of the correction coating in advance prior to the intercoat spraying step permits a quick transfer of the substrate to the intercoat drying step. Such portions as irregularities or incompleteness in the spraying of the intercoating paint may be experimentally determined in advance. This can be also said true of the overcoat spraying step in which the overcoating paint is sprayed in such an amount as exceeding its sagging threshold value.

BRIEF DESCRIPTION OF THE DRAWINGS

FIGS. 16 and 17 are cross sectional views illustrating a variation of a connection of a rotational jig with the carriage; in which FIG. 16 is a cross sectional view taken along X16—X16 of FIG. 17 and FIG. 17 is a side cross sectional view;

FIGS. 18 and 19 are cross sectional views illustrating a further variation of a connection of a rotational jig with the carriage; in which FIG. 18 is a cross sectional view taken along line X18—X18 of FIG. 19 and FIG. 19 is a side cross sectional view;

DETAILED DESCRIPTION OF THE PREFERRED EMBODIMENTS

Outline of the Coating Method

Figure 1:
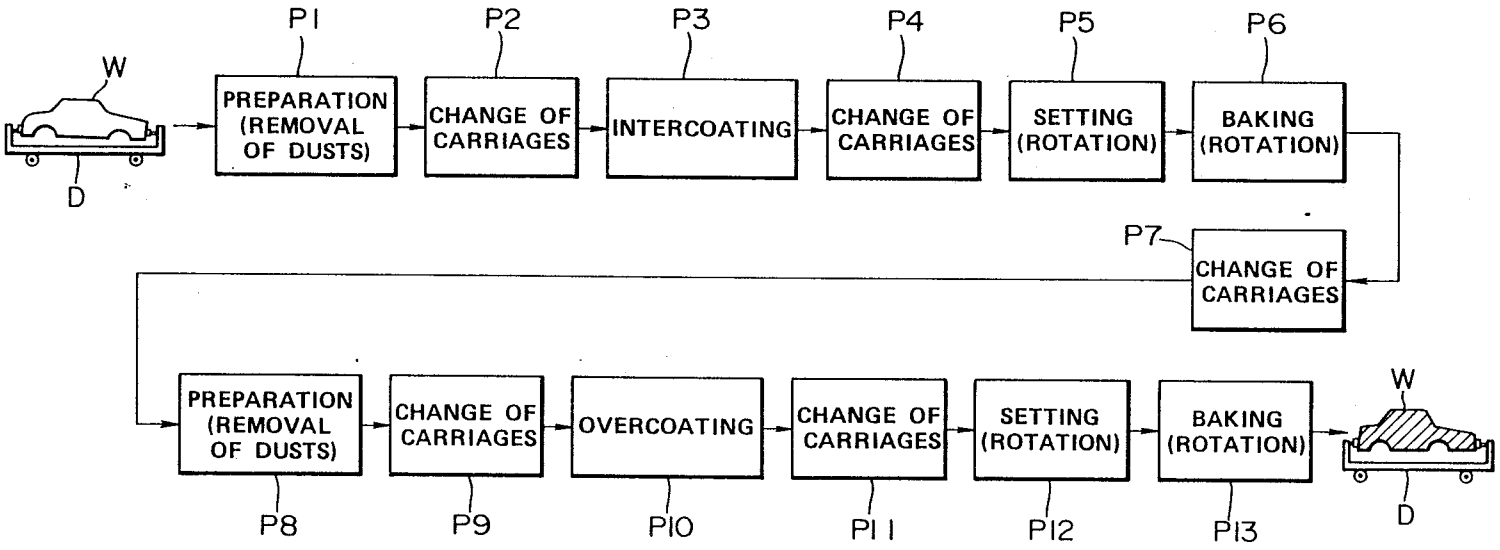
FIG. 1 is a schedule drawing illustrating a series of steps for one embodiment according to the present invention.

FIG. 1 shows an outline of the steps of the coating method according to the present invention, in which a vehicle body W as a substrate is coated from step P1 to P13.

To a preparation step P1 is conveyed the vehicle body W by a carriage D after an undercoating paint was coated by means of conventional electrodeposition in known manner. In the preparation step P1, dust and other foreign materials are removed from the vehicle body W, for example, by vacuum suction.

In step P2, the vehicle body W is transferred from the carriage D on which it is loaded during the preparation step P1 to a step P3 in which an intercoating paint is sprayed. In step P4, the vehicle body W is then transferred to another carriage D, and the intercoat is dried in a setting step P5 and a baking step P6.

After the drying, the vehicle body W is transferred to another carriage D in a step P7 and conveyed to steps P8 to P13 for the overcoating. The steps P8 to P13 are substantially the same as the steps P1 to P6 except that an overcoating paint is used in place of the intercoating paint. A description of the steps P8 to P13 will be omitted for avoidance of explanation in duplicate. The vehicle body W is then conveyed after completion of the overcoating to an assembly line.

Spraying and Drying of Paints

Paints are sprayed in the step P3 for the intercoating and in the step P10 for the overcoating, and the coated paints are dried in the steps P5 and P6 for the intercoating and in the steps P12 and P13 for the overcoating. As have mentioned immediately hereinabove, the steps P3 to P6 are substantially the same as the steps P10 to P13 so that only the steps P3 to P6 for the intercoating will be described in detail and a description on the steps P10 to P13 will be omitted for brevity of explanation.

The intercoating paint is sprayed in the step P3 on the undercoat surface of a substrate such as the vehicle body W in an amount larger than a sagging threshold value. The paint usually used for intercoating purposes has a sagging threshold value of approximately 40 μm; in this step P3, the intercoating paint is sprayed in an amount much larger than the sagging threshold value, for example, 60 μm. An estimated correction coating is carried out prior to this intercoating. This will be described in detail as well as the spraying of the paint in an amount beyond the sagging threshold value.

Figure 2:
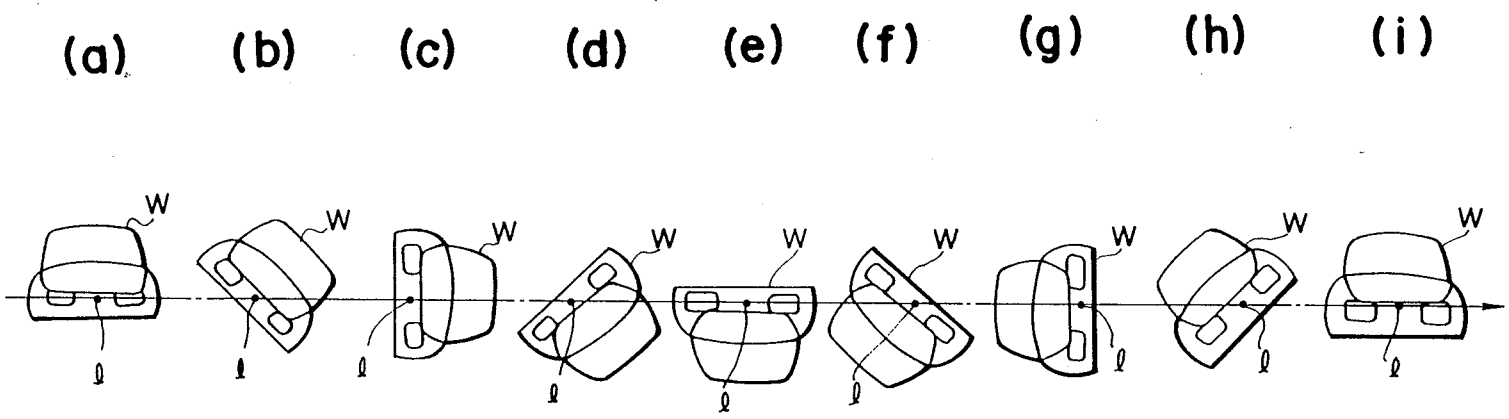
FIGS. 2(*a*) to 2(*i*) are views each illustrating the rotational position of a vehicle body.

After the intercoating in the step P3, the vehicle body W is transferred to the different carriage D in the step P4 as quick as possible and it is conveyed to the step P5 where the coated paint is set. In the setting step P5, the vehicle body W is turned about its axis l extending horizontally or longitudinally (in this example) through the vehicle body W as shown in FIGS. 2(*a*) to 2(*i*). A temperature profile for the setting step P5 may be ambient or elevated in a range from 40° to 60° C., and the temperature profile for the setting step P5 is lower than a temperature profile for the baking step P6. The setting step P5 serves as evaporating paint components having low boiling points in advance to avoid a rapid evaporation thereof in the baking step P6 whereby formation of pinholes can be avoided.

In the baking step P6, temperatures in the range higher than that applied to the setting step P5 are added to the vehicle body W and the intercoated layer is baked. The vehicle body W is rotated in this step in substantially the same manner as in the setting step P5 as shown in FIGS. 2(*a*) to 2(*i*).

The rotation of the vehicle body W about its horizontal axis in the steps P5 and P6 permits the drying of the paint coated in an amount larger than its sagging threshold value without sagging whereby there is provided an intercoat with such a higher degree of evenness that conventional procedures cannot provide. It is thus possible to avoid the use of a wet rubbing treatment which has been conventionally used between the intercoat spraying step P3 and the intercoat setting step P5.

Changes of the carriages D in the steps P4 and P11 are made in order to avoid adhesion of the paints to the carriages D to be used in the drying steps P5, P6, P12 and P13. In the spraying steps P3 and P10, sprays of the paints are caused to adhere to the carriages D with the vehicle body W loaded thereon so that such sprays may be caused to come off from the carriages D and consequently suspended as dust in air if the carriages D are used to convey the coated vehicle body W to the following drying steps. Such dust may adhere to the vehicle body W leading to an impairment of the quality of the coat surface. Changes of the carriages D in the steps P2, P7 and P9 are also made in order to minimize adverse influences from floating dust in air upon the coat surface; however, the necessity of these steps is not so important as the changes of the carriages D in the steps P4 and P11.

Relationship of Evenness with Rotation and Wet Rubbing

Figure 3:
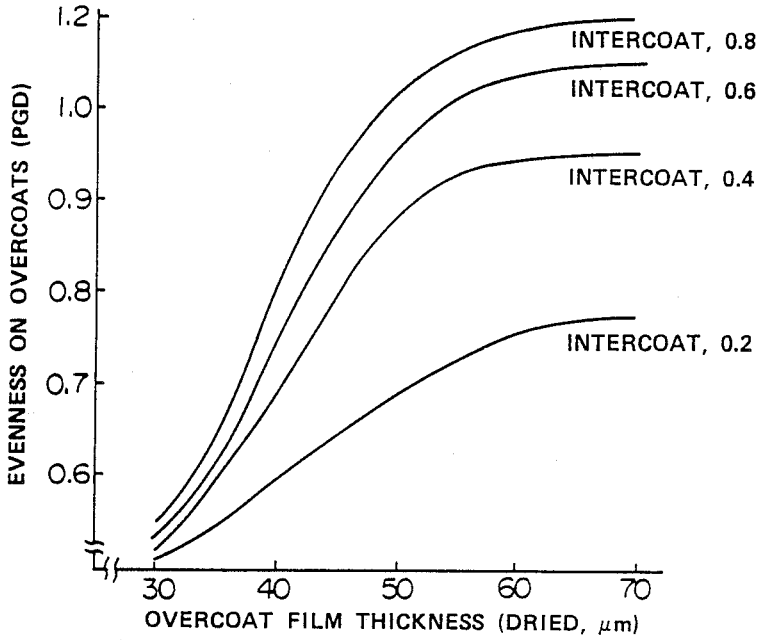
FIG. 3 is a graph illustrating the relationship of evenness on finish overcoat surfaces vs. overcoat film thicknesses.

FIG. 3 shows a graph demonstrating the relationship of degrees of evenness with film thicknesses of overcoats when intercoats with varying film thicknesses are formed. This graph is shown to demonstrate influences of the degrees of evenness on the intercoat surfaces upon degrees of evenness on the overcoat surfaces. The degree of evenness on the coat surface may be represented by a known PGD value which represents a degree of identification of an image reflected from the coat surface. It is understood that the degree of evenness becomes higher as the PGD value gets larger. As shown in FIG. 3, it is noted that, as the PGD values of the intercoat surfaces increase from 0.2 through 0.4 and 0.6 to 0.8, the degrees of evenness on the corresponding overcoat surfaces get higher. It is further noted that, in instances where the degrees of evenness on the intercoat surfaces are identical to each other, the overcoat surface with a thicker film thickness provides a higher degree of evenness.

Figure 4:
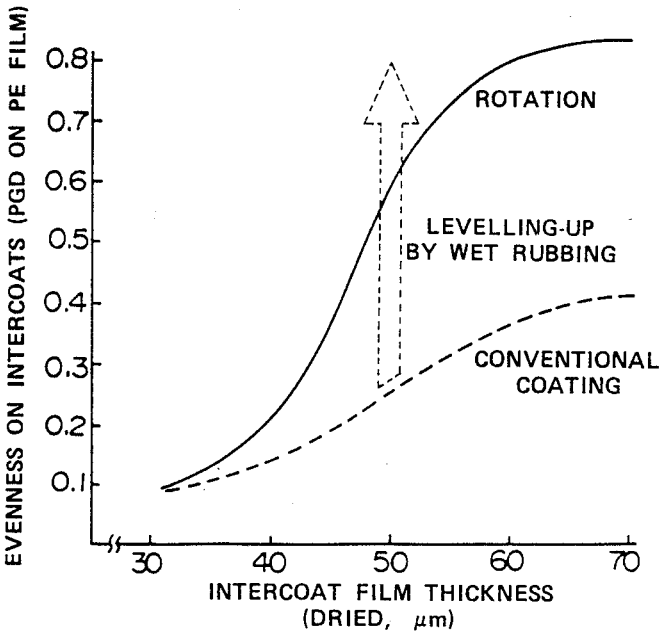
FIG. 4 is a graph illustrating the relationship of evenness on intercoat surfaces vs. intercoat film thickness.

The data shown in FIG. 3 were obtained under the following test conditions:

For intercoating:
- Paint: Polyester melamine
- Color: Gray
- Viscosity: 22 seconds/Ford Cup #4
- Film Coater:
  - Minibell
  - Sprayed twice at the interval of 3 minutes For overcoating:
- Paint: Polyester melamine
- Color: Red
- Viscosity: 20 seconds/Ford Cup #4
- Film Coater:
  - Minibell
  - Sprayed twice at the interval of 3 minutes FIG. 4 shows a graph demonstrating relationships of degrees of evenness on intercoat surfaces with film thicknesses of intercoats. This graph indicates an influence of the rotation of the intercoated substrates upon the degrees of evenness on the intercoat surfaces. As shown by the broken lines in FIG. 4, it is to be understood that, although the degrees of evenness on the intercoat surfaces produced by conventional procedures can be improved as the intercoats are made thicker, they are too low so that the wet rubbing treatment is required to raise their degrees of evenness to a greater extent. On the contrary, it is understood from the graph shown by the solid line in FIG. 4 that, in instances where the intercoating paints are sprayed in amounts beyond their sagging threshold values and the intercoats have been dried while the intercoated substrates have been turned, the degrees of evenness on the intercoat surfaces have been improved to a remarkable extent compared to those obtained by conventional techniques.

The data shown in FIG. 4 were obtained by using the same intercoating paint as used for the tests as shown in FIG. 3 under the following test conditions:

For wet rubbing:
- Using a water-resistant paper #800, the test intercoat surface is wet-rubbed uniformly until its gloss is caused to disappear.

For rotation of the substrate:
- The substrate is rotated for the full period of 10 minutes for the setting step P5 and for the initial period of 10 minutes for the baking step P6 while a speed of rotation of the substrate is 10 r.p.m. over the drying period.

In both cases, the sagging threshold values of the coating paints were changed by changing concentrations of a thinner.

Figure 31:
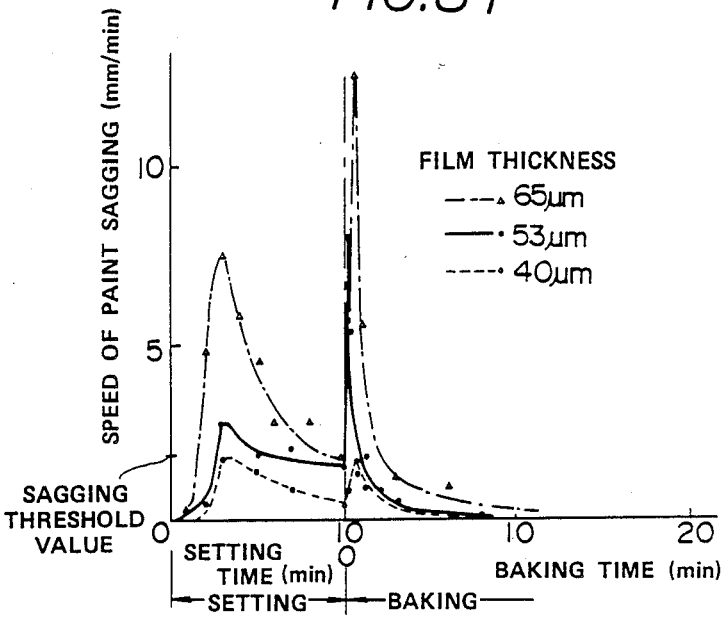
FIG. 31 is a graph illustrating the relationship of paint sagging speeds vs. setting and baking times.

Relationship of Film Thickness with Sagging Threshold Values and Rotation of Substrates with Degrees of Evenness FIG. 31 demonstrates influences of film thicknesses upon sagging threshold values using three different film thicknesses of 40 μm, 53 μm, and 65 μm. It is understood from FIG. 31 that in each case a peak of the sag has occurred at the initial stages of the setting and baking steps. The sagging threshold value is usually defined as a value at the time when the sag is caused to occur at a rate ranging from 1 to 2 mm per minute. It is understood that, if the sag would occur at a rate of 2 mm or more per minute when visually observed, the coat surface is made not good. The maximum film thicknesses of conventional paints that had ever obtained at a range below the sagging threshold value were as thin as about 40 μm.

Figure 32:
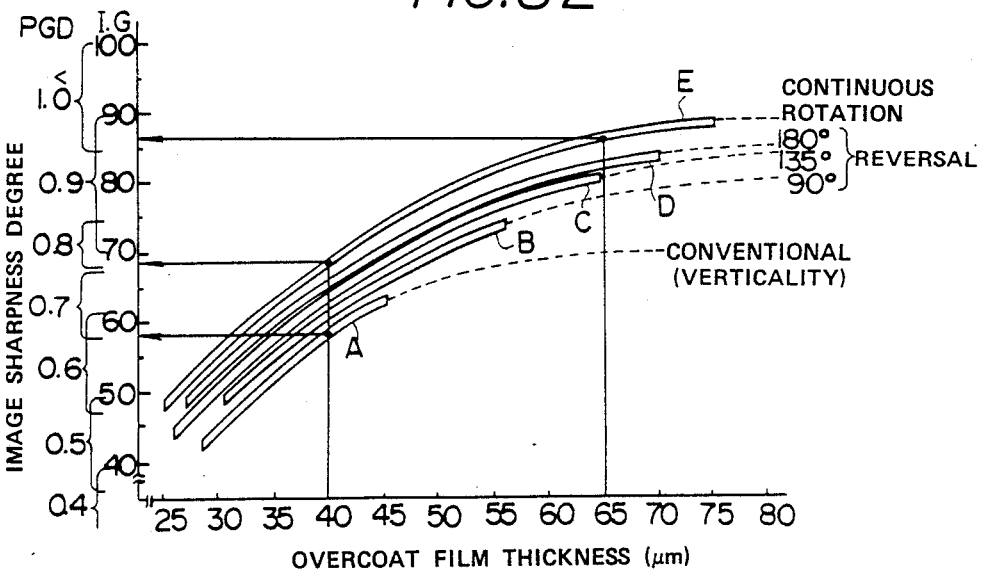
FIG. 32 is a graph illustrating the relationship of image sharpness degree vs. overcoat film thickness.

FIG. 32 shows influences of horizontal rotations of the vehicle body W about the horizontal and longitudinal axis upon degrees of evenness on overcoat surfaces. In FIG. 32, reference symbol A denotes a state of the overcoat obtained using a conventional coating method where the vehicle body W is not subjected to rotation. Reference symbol B denotes a state of the overcoat or top coat obtained by rotating the vehicle body W in the clockwise direction at 90° and then reversing it in the counterclockwise direction to the original position, namely, rotating it from the position of FIG. 2(*a*) through (*b*) to (*c*) and then reversing it from the position (*c*) through (*b*) back to (*a*). Reference symbol C denotes a state of the top coat obtained by rotating the vehicle body W at 135° and then reversing it to the original position, namely, rotating it from the position of FIG. 2(*a*) through (*b*) and (*c*) to (*d*) and then returning it from the position of FIG. 2(*d*) through (*c*) and (*b*) back to the original position (*a*). Reference symbol D denotes a state of the top coat obtained by rotating the vehicle body W at 180° from the position of FIG. 2(*a*) through (*b*), (*c*) and (*d*) to (*e*) and then back to the original position of FIG. 2(*a*) through (*d*), (*c*) and (*b*) from (*e*). In FIG. 32, reference symbol E denotes a state of the overcoat obtained when the vehicle body W is rotated around in one way from the original position of FIG. 2(*a*) through (*b*), (*c*), (*d*), (*e*), (*f*), (*g*) and (*h*) back again to the original position of FIG. 2(*i*).

As is apparent from the results of FIG. 32, it is to be understood that the top coats with higher degrees of evenness are gained when the vehicle body W is rotated, as shown by the reference symbols B, C, D and E in FIG. 32, than when it is not rotated, as shown by the reference symbol A in FIG. 32, in instances where film thicknesses of the top coats are identical to each other. It is noted that, in instances where the vehicle body W is rotated, the round rotation of the vehicle body W in one direction by 360° is preferred to provide a top coat with a higher degree of evenness. It is also noted that, in instances where the vehicle body W is not rotated as in conventional coating methods, a limit exists to the film thickness of the top coat and thus to the degree of evenness.

As shown in FIG. 32, in instances when the film thickness of 65 μm was formed on the vehicle body W by rotating it by 360° in one direction, an image sharpness degree I.G. of the overcoat was found to be 87, namely, the lowest limit value when the PGD value is 1.0. When the film thickness of 40 μm was formed without rotation of the vehicle body W, an image sharpness degree I.G. was found to be 58 (the lowest limit value when the PGD value is 0.7), while an image sharpness degree I.G. was found to be 68 (the lowest limit value when the PGD degree is 0.8) when the vehicle body W is rotated at 360°.

In the above definition terms, an image sharpness degree I.G. (image gloss) is a percentage of an objective image sharpness when it is defined as 100 when a mirror surface of a black glass is used, and a PGD value is a value rating identification degrees of reflected images from 1.0. The values get lower as degrees of evenness get lower.

The data shown in FIGS. 31 and 32 were obtained under the following test conditions and these conditions are the same as those used for the steps P10, P12 and P13:

(a) Paint: melamine alkyd (black)
Viscosity: 22 seconds/20° C. (measured by Ford Cup #4)
(b) Film coater:
Minibell (16,000 r.p.m.)
Shaping air: 2.0 kg/cm$^2$
(c) Spraying amounts: sprayed two times
First time: 100 cc/minute
Second time: 150–200 cc/minute
(d) Setting time/temperature: 10 minutes/room temperature
(e) Baking temperature/time: 140° C./25 minutes
(f) Degree of undercoat evenness: 0.6 (PGD value) (intercoat over PE tape)
(g) Time period for rotation and reversal:
10 minutes (for the setting step)
10 minutes (for the baking step)
(h) Material to be coated: The side surfaces of a square pipe with a 30 cm side are coated and supported at its center rotatively.
(i) Rotational speed of the material to be coated: 6, 30 and 60 r.p.m. (It is noted that no difference has in fact been recognized therebetween.)

Color Intercoating

In order to minimize the film thickness of the overcoat or top coat, there is used in the step P3 the intercoating paint having a color identical or similar to a color of the overcoat to be used in the overcoating step P10. In this case, the film thickness of the intermediate coat or intercoat to be sprayed in the step P3 is rendered larger while the film thickness of the overcoat to be sprayed in the step P10 is rendered smaller, for example, 15 to 30 μm. And the overcoating paint is sprayed in this case in such an amount as exceeding its sagging threshold value, and the substrate such as the vehicle body W on which the paint has been overcoated is turned in the steps P11 and P12.

The following table shows effects of the color intercoating on the overcoats formed on the intercoat.

TABLE

| Film Thickness of Undercoat | Film Thickness of Intercoat | Film Thickness of Overcoat | Masking Ability | Anti-chipping | Degree of Evenness (PGD value) I A | I B | II |
|---|---|---|---|---|---|---|---|
| 20 | 50 | 25 | | 3 | 0.6 | 0.8 | 1.2 |
| 20 | 50 | 30 | | 4 | 0.7 | 0.9 | 1.2 |
| 20 | 60 | 15 | | 5 | 0.5 | 0.7 | 0.8 |
| 20 | 60 | 20 | | 5 | 0.6 | 0.8 | 1.2 |
| 20 | 70 | 15 | | 5 | 0.6 | 0.8 | 0.9 |
| 20 | 70 | 20 | | 5 | 0.7 | 0.9 | 1.2 |

In the above table, the film thickness of the coat means an average film thickness of all the measured thinner and thicker portions of the coat and the symbol and numerals denote the following:

For masking ability:

The reference symbol "O" denote that the masking ability is so sufficient that no color of the intercoat can be seen through the overcoat.

For anti-chipping:

Determination has been done by the number of rust spots using Gravello test.
5:0–5 rust spots (excellent)
4:5–15 rust spots (good)
3:16–30 rust spots (average)
2:31–50 rust spots (poor)
1: more than 50 rust spots (bad)

Details of the Gravello test are as follows:
1. Gravello tester and materials therefor:
nozzle size: 50%
distance: 300 mm
stone: JIS #A500/7 crushed stone, 30 grams
air pressure: 2.5 kg/cm$^2$
II. Method: After the test, salty water was sprayed for 72 hours and the number of rust spots occurred was counted.

For degree of evenness (PGD value):
I: The overcoat was formed by conventional coating procedures. Reference symbol "A" denotes that no wet rubbing was done after the intercoat had been dried, and "B" denotes that the intercoat was wet rubbed after dried.
II: The overcoat was formed in accordance with the coating method according to the present invention, in which the overcoat was sprayed in the amount beyond its sagging threshold value and the substrate was rotated during the drying step while no wet rubbing was effected.

Details of the coating are as follows:
For substrate:
A steel plate treated with zinc phosphate was used as a substrate.
For undercoating:
cationic electrodeposition (black)
thickness: 20 μm
baking: 170° C., 30 minutes
For intercoating:
paint: polyester melamine
color: white (to comply with the color of the overcoat)
viscosity: 24 seconds/Ford Cup #4
film coater: Minibell, sprayed twice at the interval of 3 minutes
baking: 140° C., 25 minutes
For overcoating:
paint: polyester melamine
color: white
viscosity:
a. For evenness degree classification "I" in the above table:
Among paints having the viscosity of 16–22 seconds/Ford Cup #4, the paint was chosen which has a possible small viscosity in the range in which no sags occur.
b. For evenness degree classification "II" in the above table:
For film thicknesses of 25 μm or more, 16 seconds/Ford Cup #4
For film thicknesses of 20 μm or less, 13 seconds/Ford Cup #4
film coater: Minibell, sprayed once
baking: 140° C., 25 minutes
For rotation of the substrate:
10 r.p.m. for 10 minutes at the initial stage of the setting step and another 10 r.p.m. for additional 10 minutes at the initial stage of the baking step As will be apparent from the above table, the coating method according to the present invention can provide the overcoat or top coat with excellent anti-chipping and masking abilities and sufficiently high degrees of evenness. It further permits spraying of the overcoating paint to a thinner film thickness while rendering the intercoat thicker.

From the data shown in the above table, it is to be noted that the coating method according to the present invention provides overcoats having extremely higher degrees of evenness represented by the PGD values usually over 1.0 without wet rubbing. In the conventional coating method in which the intercoat and overcoat layers are formed by spraying in each case to the film thickness of 40 μm, the overcoat surface can give the PGD value of approximately 0.7 even if the intercoat was subjected to wet rubbing after it was dried.

It is further to be noted that a combined film thickness of the intercoat and overcoat layers may be in the range preferably from approximately 70 to 100 μm from the point of view of ensuring a sufficiently thick coat as in conventional coating methods. In this preferred range, the film thickness of the intercoat layer may be larger than approximately 50 μm that is thicker than conventional intercoat layers and it may be preferably larger than approximately 60 μm in order to ensure better anti-chipping ability. Furthermore, the film thickness of the overcoat may be thinner than approximately 30 μm that is thinner than conventional intercoats and it is further preferably in the range as thin as from approximately 20 to 25 μm in order to adequately reduce a consumption of the overcoating paints which is much more expensive than the intercoating paints. It is also possible to make the overcoat a film thickness of 15 μm; however, this thin overcoat will give a less degree of evenness than a thicker overcoat.

In instances where a paint is sprayed to a thinner film thickness but in such an extent as causing sags, the paint may be conveniently prepared by adjusting amounts or ratios of resin components of the paint and solute components thereof.

The coating method according to the present invention will be described by reference to a coating system and aparatus adapted to be designed therefor.

Rotation Jig

An example of a rotation jig mounted on a carriage D will be described in detail which is used for supporting the substrate such as the vehicle body W and rotating the substrate about its horizontal and longitudinal axis.

Figure 5:
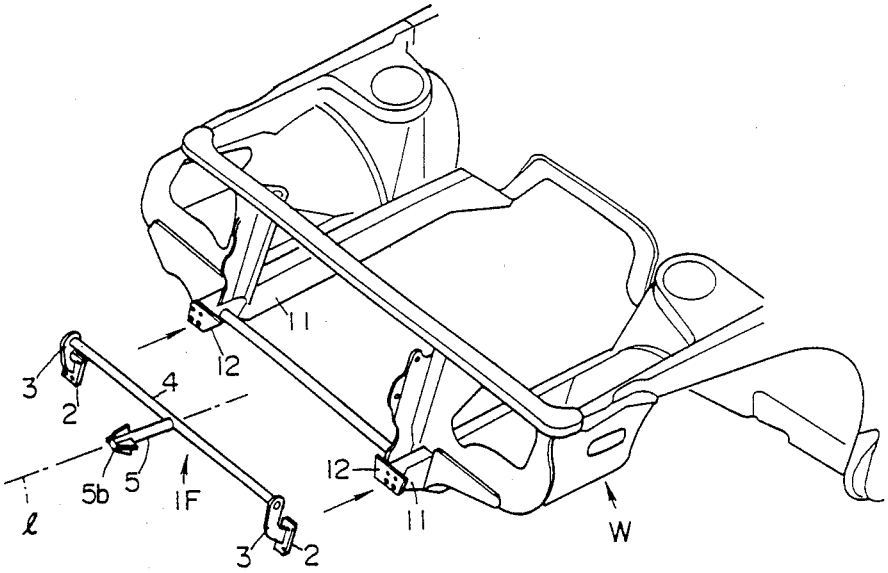
FIGS. 5 and 6 are perspective views illustrating each a jig for rotating the vehicle body.
Figure 6:
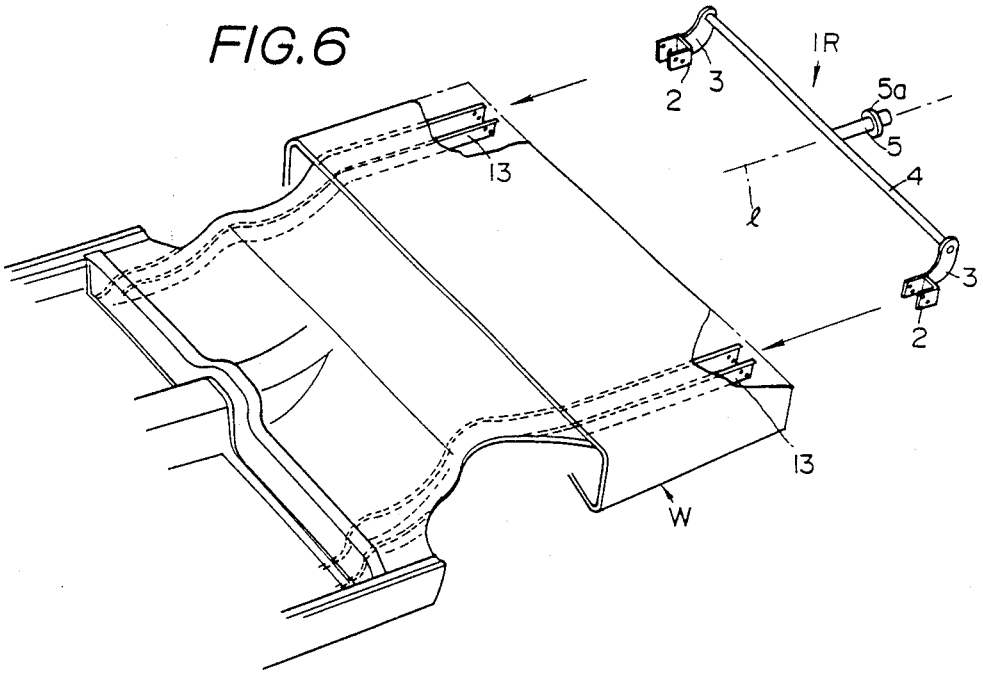

Referring to FIGS. 5 and 6, the rotation jig is shown to include a front jig portion 1F mounted to the front side of the vehicle body W and a rear jig portion 1R mounted to the rear side thereof.

As shown in FIG. 5, the front jig portion 1F includes a pair of left and right mounting brackets 2, 2, a pair of left and right stays 3, 3 welded to the corresponding mounting brackets 2 and a connection bar 4 connecting the pair of the stays 3, 3, and a rotary shaft 5 connected integrally to the connection bar 4. The front rotation jig 1F is fixed through the brackets 2, 2 to the forward end portions of a front reinforcing member of the vehicle body W such as front side frames 11, 11. The front side frames 11, 11 are usually provided with brackets 12, 12 for mounting a bumper (not shown) so that the brackets 2, 2 are fixed detachably with bolts (not shown) to the brackets 12, 12.

Referring now to FIG. 6, the rear rotation jig 1R is shown to have substantially the same construction as the front rotation jig 1F. In FIG. 6, the elements of the rear rotation jig 1R having the same function are provided with the same reference numerals as the front rotation jig 1F and a new description on those elements will be omitted here for brevity of explanation. The rear rotation jig 1R is mounted to the vehicle body W by fixing the brackets 2, 2 with bolts to floor frames 13, 13 disposed at the rear end portion of the vehicle body W as a rigidity adding member. As the rear end portion of the floor frames 13 are usually welded in advance with brackets for mounting bumpers, the rear rotation jig 1R may be mounted to the brackets for mounting the bumpers.

Figure 7:
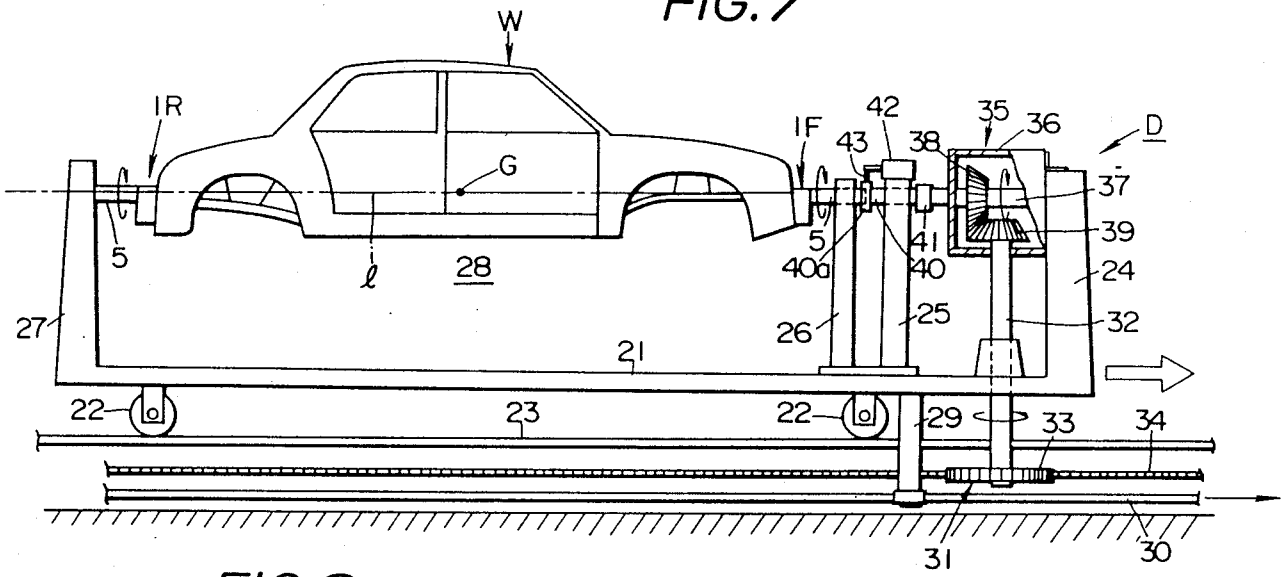
FIG. 7 is a side elevational view illustrating one example of a carriage for conveying a vehicle body loaded so as to be rotated thereon.
Figure 9:
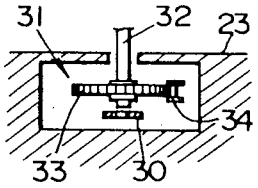
FIG. 9 is a cross sectional view taken along line X9—X9 of FIG. 8.
Figure 8:
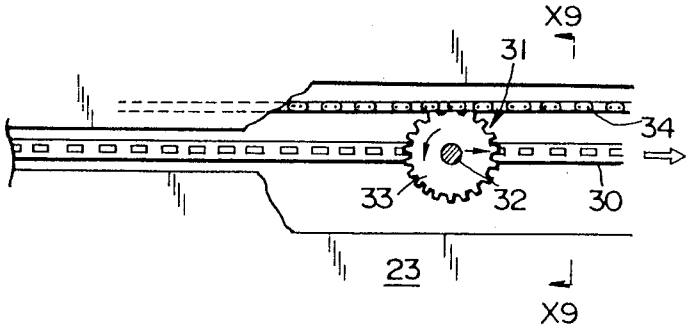
FIG. 8 is a partially cut-out plane view illustrating a mechanism, disposed under passageways, for moving the carriage.

The front and rear rotation jigs 1F and 1R are mounted in such a state that their respective rotary shafts 5 are disposed so as to allow their common rotation axis l to coincide with each other and be in a straight line extending in the longitudinal direction of the vehicle body W. It is preferred that the rotation axis l is designed to pass through the center of gravity G of the vehicle body W as shown in FIG. 7. This arrangement for the rotation axis serves as preventing a speed of rotation from deviating to a large extent, thereby diminishing shocks originating from a deviation of rotations. Such shocks may cause a disorder in sagging so that this arrangement of mounting the front and rear rotation jigs 1F and 1R is advantageous in prevention of undesirable sags from occurring.

The front and rear rotation jigs 1F and 1R may be prepared for exclusive uses according to kinds of vehicle bodies.

Carriages

The carriages are used for transferring the vehicle body W in the steps P5, P6, P12, and P13. Each of the carriage D used therein is provided with a mechanism for rotating or turning the vehicle body W loaded thereon.

Referring to FIG. 5, the carriage D is shown to include a base 21 and wheels 22 mounted to the base 21 with the wheels 22 arranged to operatively run on rails 23. On the base 21 is mounted one front support 24, two intermediate supports 25 and 26, and one rear support 27, each standing upright from the base 21, as shown in the order from the right to left in FIG. 7. Between the intermediate supports 25, 26 and the rear support 27 is formed a supporting space 28 extending in a widely spaced relationship in the longitudinal direction.

The vehicle body W is loaded on the carriage D and supported in the supporting space 28 in such a manner that the front end portion of the vehicle body W is rotatively supported through the front rotation jig 1F to the intermediate support 26 while the rear end portion thereof is rotatively supported likewise through the rear rotation jig 1R to the rear support 27.

Figure 10:
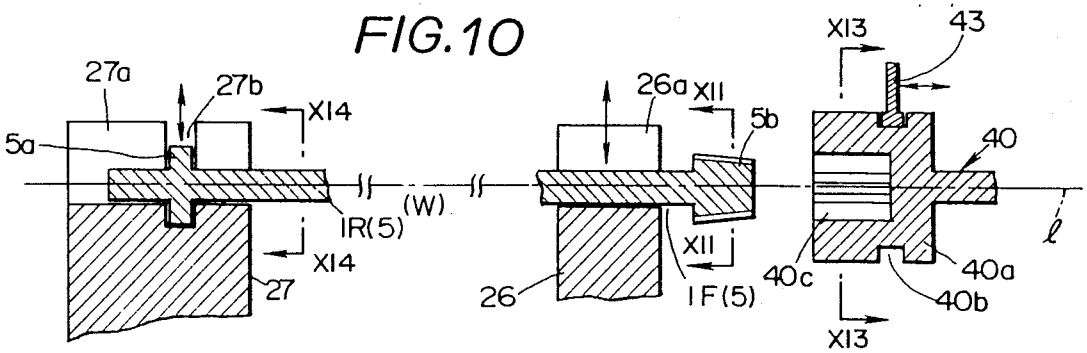
FIG. 10 is a cross sectional side view illustration a connection of a rotational jig with the carriage.
Figure 12:
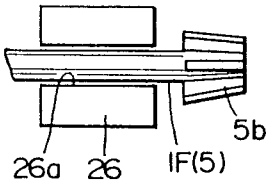
FIG. 12 is a plane view of FIG. 11.
Figure 11:
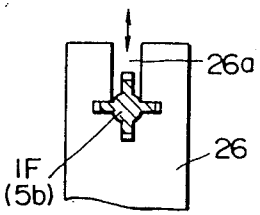
FIG. 11 is a cross sectional view taken along line X11—X11 of FIG. 10.
Figure 15:
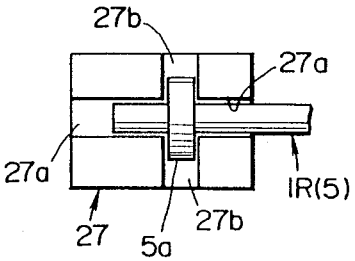
FIG. 15 is a plane view of FIG. 14.
Figure 14:
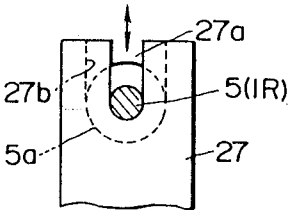
FIG. 14 is a cross sectional view taken along line X14—X14 of FIG. 10.

The front and rear rotary shafts 5 of the respective front and rear rotation jigs 1F and 1R are connected to the intermediate support 26 and the rear support 27 so as to be detachable from the vertical direction. The rear rotary shaft 5 of the rear rotation jig 1R is engaged with the rear support 27 so as to be not movable in the direction of the rotation axis l. At this end, the intermediate support 26 is provided at its top end surface with a cut-out portion **26*a* opening upwardly as shown in FIGS. 10, 11 and 12, while the rear support 27 is provided at its top end surface with a cut-out portion 27*a* opening upwardly as shown in FIGS. 10, 14 and 15. These cut-out portions 26*a* and 27*a* are formed in a size large enough to allow the front and rear rotary shafts 5 to fit around them, respectively, and be inserted thereinto. The rear rotary shaft 5 of the rear rotation jig 1R is provided with a flange portion 5*a*, and the rear support 27 is provided with a second cut-out portion 27*b* in a shape corresponding to and engageable with the flange portion 5*a* of the rear rotary shaft 5R communicating with the first cut-out portion 27*a*. This construction permits the connection or disconnection of the rear rotation jig 1R to or from the first and second cut-out portions 27*a* and 27*b* of the rear support 227 in a downward or upward direction. This construction also permits the rear rotation jig 1R to be securely connected to the rear support 27 by means of the stopper action by the flange portion 5*a* so as to be not movable in either of the forward and backward directions. A force of rotation for turning the vehicle body W loaded on the carriage D is applied to the vehicle body W through the front rotary shaft 5 of the front rotation jig 1F. At this end, the front rotary shaft 5 thereof is provided at its forward end portion with a connection portion 5*b* (see also FIG. 5**) as will be described later.

From the base 21 extends downwardly a stay 29 to a lower end of which is connected a retraction wire 30 that is of endless type and is driven in one direction by a motor (not shown). The retraction wire 30 thus drives the carriage D in a predeterminated conveyance direction. The motor should be disposed in an explosion proof place.

A rotation of the vehicle body W is carried out using a movement of the carriage D, that is, using a displacement of the carriage D with respect to the rails 23. The displacement of the carriage D is converted into a force of rotation by means of a converting mechanism 31 which includes a rotary shaft 32 supported rotatively by the base 21 and extending vertically from the base, a sprocket 33 fixed on the lower end portion of the rotary shaft 32, and a chain 34 engaged with the sprocket 33. The chain 34 is disposed parallel to the retraction wire 25 and in such a state that it does not move along the rails 23. With this arrangement, as the carriage D is retracted by the retraction wire 25, the sprocket 33 engaged with the unmovably mounted chain 34 allows the rotary shaft 32 to rotate, thus leading to the rotation of the vehicle body W.

The rotation of the rotary shaft 32 is transmitted to the front rotary shaft 5 of the front rotation jig 1F through a transmitting mechanism 35. The transmitting mechanism 35 includes a casing 36 fixed on the rear side surface of the front support 24, a rotary shaft 37 supported rotatively to the casing 36 and extending in the transverse direction, a pair of bevel gears 38 and 39 for rotating the rotary shaft 37 in association with the rotary shaft 32, and a connection shaft 40 connected to the front support 25 rotatively and slidably in the longitudinal direction. The connection shaft 40 is connected to the rotary shaft 37 by means of the spline connection system at a position represented by 41 in FIG. 7. This construction permits a rotation of the connection shaft 40 in association with the rotation of the rotary shaft 32. The rotary shaft 37 and the connection shaft 40 are arranged so as to allow their rotation axis l to coincide with each other in the longitudinal direction.

Figure 13:
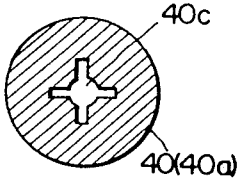
FIG. 13 is a cross sectional view taken along line X13—X13 of FIG. 10.

The connection shaft 40 is connected to or disconnected from the front rotary shaft 5 of the front rotation jig 1F. As shown in FIGS. 10 to 12, the front rotary shaft 5 of the front rotation jig is provided at its tip portion with a connecting portion **5*b* in a cross shape, while the connection shaft 40 is provided at its rear end portion with a box member 40***a* having an engaging hollow portion 40*c* engageable tightly with the connecting portion 5*b* of the front rotary shaft 5 as shown in FIGS. 10 and 13. By moving the connection shaft 40 in a sliding manner through a rod 43, for example, using a hydraulic cylinder 42, the connecting portion 5*b* is allowed to be connected to or disconnected from the engaging hollow portion 40*c* of the box member 40*a*. At the time of connection, the connection shaft 40 is rotatable integrally with the rotary shaft 5. The rod 43 is disposed in a ring groove 40*b* formed on the outer periphery of the box member 40*a*, as shown in FIG. 10, in order to interfere with the rotation of the connection shaft 40.

With the above arrangement, the front and rear rotary shafts 5, 5 of the respective front and rear rotation jigs 1F and 1R are allowed to be supported to the intermediate support 26 and the rear support 27 in such a manner as being rotatable but unmovable in the forward and rearward directions, when the vehicle body W is lowered down to be loaded on the carriage D in a state of the connection shaft 40 being displaced toward the right in FIG. 7. Thereafter the connecting portion 5*b* of the rotary shaft 5 is engaged with the engaging hollow portion 240*c* of the connection shaft 40, whereby the vehicle body W is allowed to rotate about the predetermined rotation axis l by retracting the carriage D by means of the retraction wire 30.

The vehicle body W can be unloaded from the carriage D in the reverse order.

Referring now to FIGS. 16 to 19, there are shown examples of variants in connection systems between the rotation jig 1F and the connection shaft 40, in which the same elements are represented by the same reference numerals.

Figure 16:
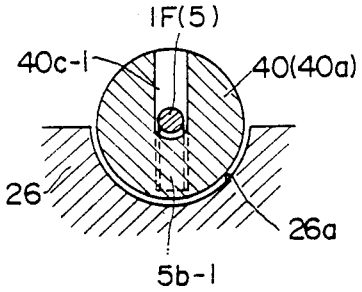
Figure 17:
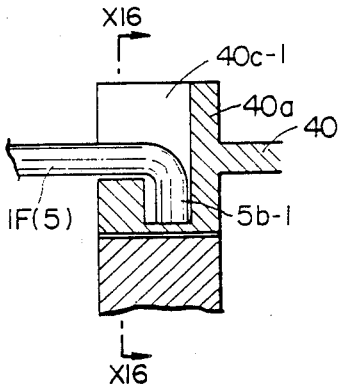

As shown in FIGS. 16 and 17, a cut-out portion 26*a* of the intermediate support 26 is formed in such a semicircular shape as capable of rotatively supporting a box member 40*a*. And a connecting portion 5*b*-1 of the front rotary shaft 5 of the front rotation jig 1F is formed in an L-shaped manner, while an engaging portion 40*c*-1 of the box member 40*a* is formed in such a shape that the L-shaped connecting portion 5*b*-1 is engaged unrotatively relative to the engaging portion 40*c*-1 thereof. The engaging portion 40*c*-1 has an opening on one side surface of the box member 40*a*. As the opening is directed upwardly, the front rotary shaft 5 of the front rotation jig is connected at its connecting portion 5*b*-1 to or disconnected from the connection shaft 40 through the engaging portion 40*c*-1.

Figure 18:
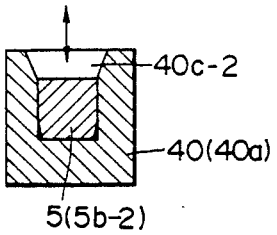
Figure 19:
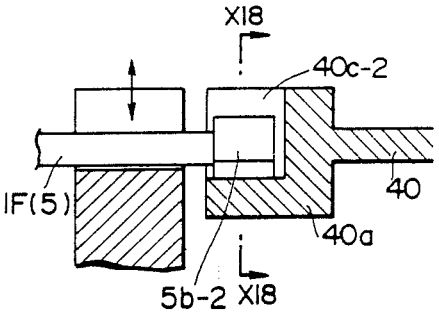

FIGS. 18 and 19 show another example of a connection arrangement similar to that shown in FIGS. 16 and 17. The connecting portion 5*b*-2 of the front rotary shaft 5 is shown to be square in cross section, while the engaging portion 40*c*-2 of the box member 40*a* is in a shape capable of receiving and fitting around the shape of the connecting portion 5*b*-2. This connection system allows the connecting portion of the rotary shaft 5 to be connected to or disconnected from the engaging portion 40*c*-2 only when the engaging portion 40*c*-2 thereof is directed in an upward direction.

In instances where the connection systems as shown in FIGS. 16 to 19 are in such a state as capable of connecting the front rotary shaft 5 of the front rotation jig 1F to or disconnecting it from the connection shaft 40, that is, in such a state that the engaging portions 40*c*-1 and 40*c*-2 are directed in an upward direction, the vehicle body W should be loaded on the carriage D so as to allow its roof panel to stand upright.

Carriage Changing Apparatus

Figure 20:
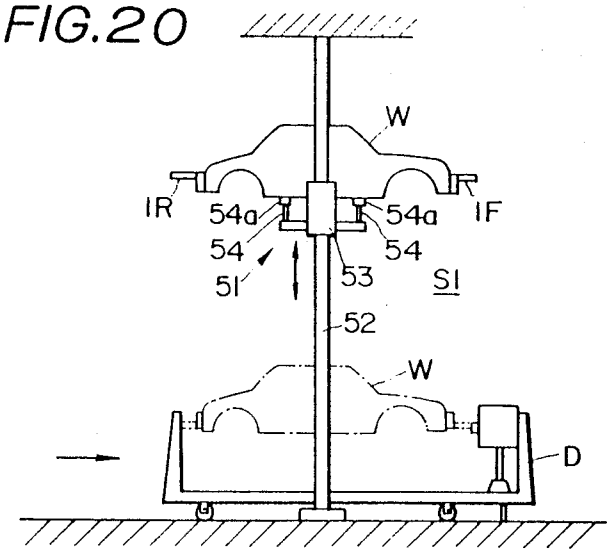
FIG. 20 is a side elevational view illustrating an example of an apparatus for changing carriages.
Figure 21:
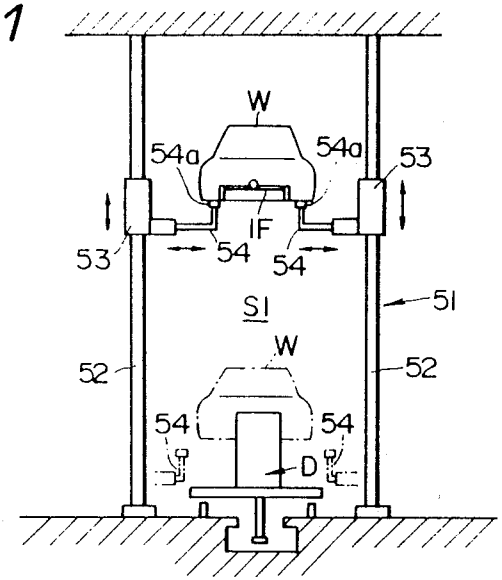
FIG. 21 is a front elevational view of FIG. 20.
Figure 22:
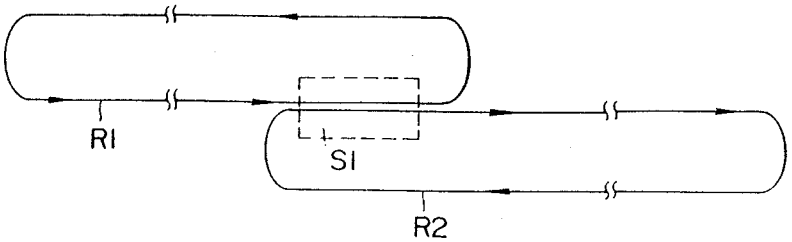
FIG. 22 is schematic plane view illustrating an example of disposition of passageways of the carriages and the position of a carriage changing apparatus.

A carriage changing apparatus is used to change the carriages D in the steps P2, P4, P7, P9 and P11 in order to unload the vehicle body W from one carriage D and load it on another carriage D. FIGS. 20 to 22 shows one example of the carriage changing apparatus.

Figure 25:
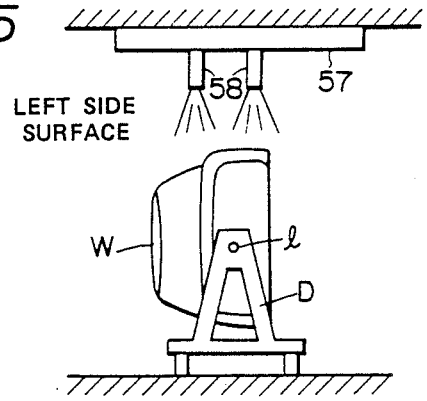

As shown in FIG. 25, the carriage changing apparatus is disposed in a loading/unloading station S1 where the locus R1 of conveyance of carriages in the previous step is approaching to the locus R2 of conveyance of carriages in the subsequent step. The carriage changing apparatus is shown to comprise basically a lifter 51 which includes a pair of guide posts 52, 52 with supporting bases 53 mounted on the guide posts 52 in such a manner as operatively moving upwardly or downwardly. The supporting base 53 is provided with a supporting arm 54 that is driven so as to extend or contract in a horizontal direction. The supporting arm 54 is provided with a pair of supporting portions 54*a* in a spaced relationship along the line of the conveyance of the carriage D.

When the carriage D with the vehicle body W loaded thereon is conveyed from the previous step to the loading/unloading station S1 and the carriage D is suspended. As the carriage D stopped, the supporting arms 54 are extended from the supporting bases 53 located at the lower end positions underneath the vehicle body W. The supporting bases 53 are then raised so as to allow supporting members 54*a* of the supporting arms 54 to support the floor frame or side sill portions of the vehicle body W and further moved upwardly to raise the vehicle body W from the carriage D. The vehicle body W is further raised to positions sufficient high for the carriage D to be evacuated from the lifter 51 in the loading/unloading station S1, as shown by the solid lines in FIGS. 20 and 21. Thereafter another carriage D is allowed to enter into a predetermined position in the loading/unloading station S1 for loading the vehicle body W currently held by the supporting arms 54. As the new carriage D stopped, the supporting base 53 is then lowered to reload the vehicle body W thereon by transferring the vehicle body W from the lifter 51. The supporting arms 54 is then lowered to a lower position and then contracted to positions closer to the supporting bases 53, as shown by the broken lines in FIG. 21, in order not to interfere with the movement of the carriage D and with entry of another carriage D that carries another vehicle body W for unloading.

It is preferred that the carriage D is fixed unmovably at the predetermined position by clamping it from every direction by means of a position apparatus or the like while the vehicle body W is being loaded or unloaded.

The carriage changing apparatus may have hangers disposed at its upper position so as to be movable intermittently. In this case, the vehicle body W may be shifted from the lifter 51 to the hanger, and the hanger then convey the vehicle body W to a new lifter 51. The vehicle body W is then transferred from the hanger to the new lifter and loaded on a new carriage D.

Spraying of Paints

The paints are sprayed on the vehicle body W in the intercoating step P3 and in the overcoating step P10. The spraying procedures to be used in these steps are substantially identical to each other so that a description will be made on the step P10.

Figure 29:
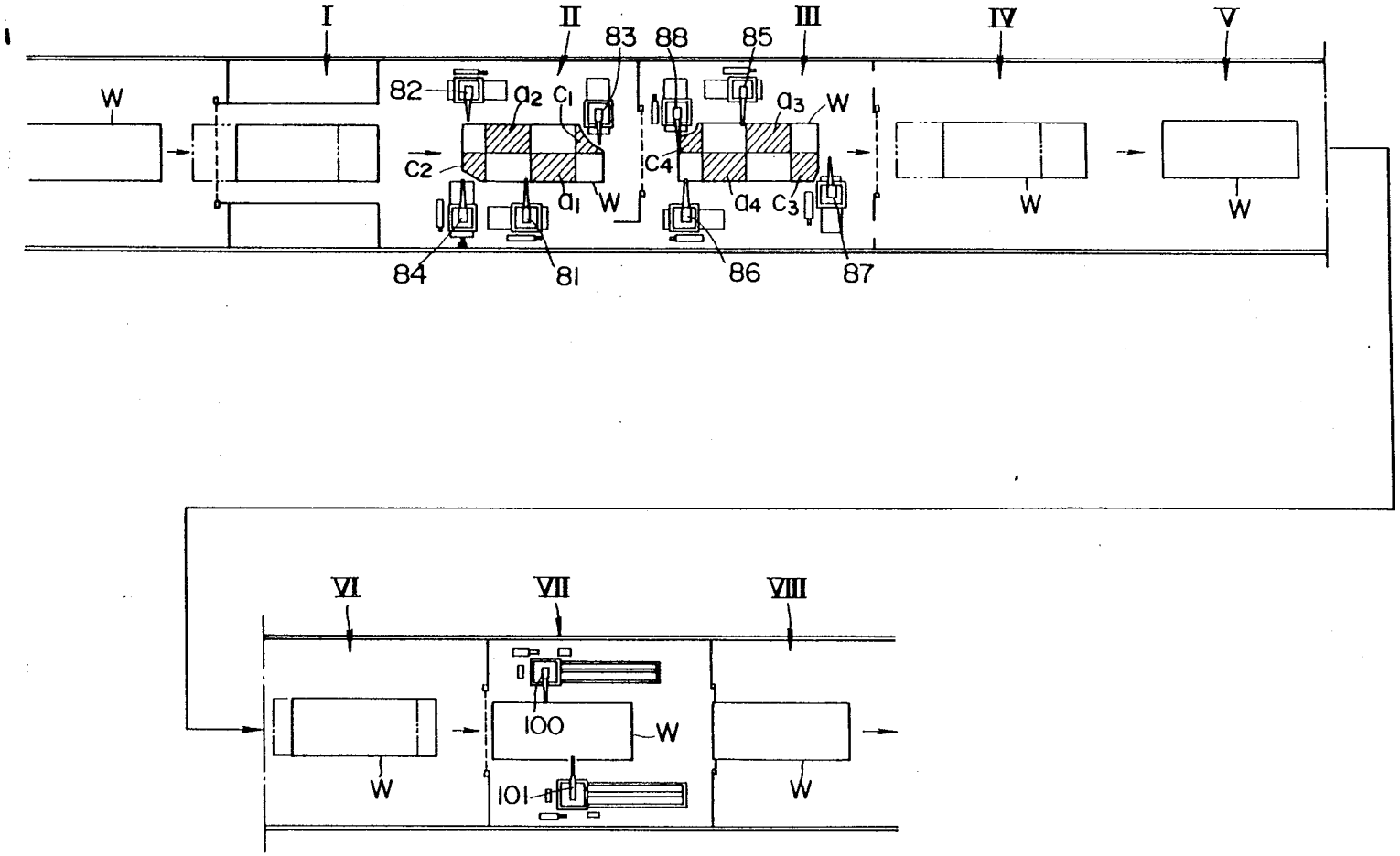
FIG. 29 is a layout of an embodiment for spraying a paint.

As shown in FIG. 29, a coating line where the vehicle body is overcoated may be divided into eight stations I to VIII, inclusive, in this order in the direction of conveyance of the vehicle body W.

Station I

The station I is disposed to transfer vehicle bodies W from the continuous conveyance system to the tact conveyance system. In this station, the vehicle body W is maintained in such a state that a bonnet 95 and a boot lid 96 are kept open for coating an engine room 90 and a trunk room 94, as shown in FIG. 30.

Figure 30:
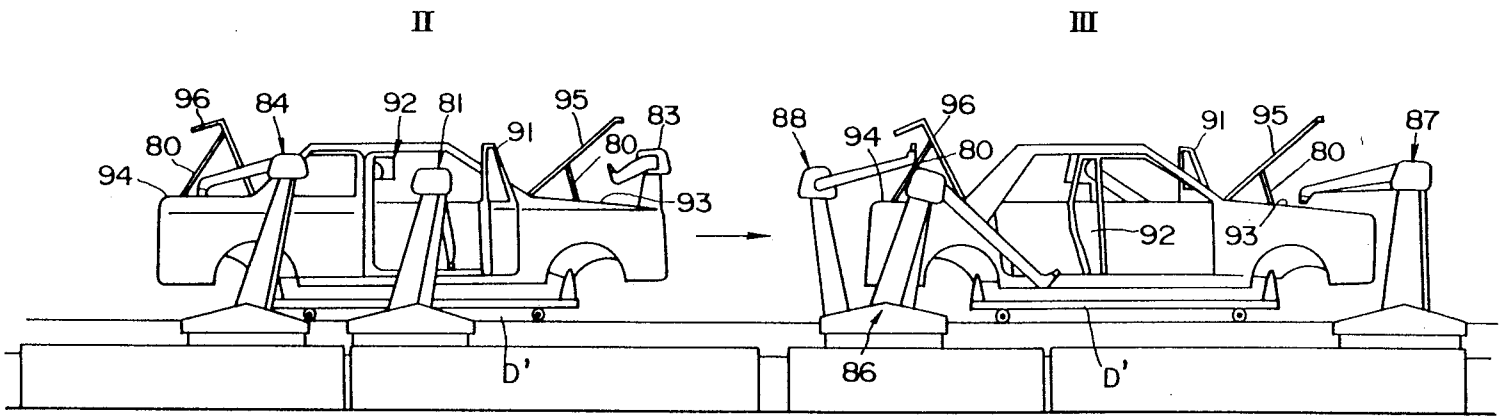
FIG. 30 is a side elevational view illustrating the essential portion of FIG. 29.

As it is not necessary to rotate the vehicle body W in this station, a carriage D is shown in FIG. 30 to be of conventional type having no rotating mechanism.

Station II

The station II is a first-stage coating station for interior coating. As shown in FIGS. 29 and 30, a first center coating robot 81 is disposed at an intermediate position of the station II along the conveyance line of the carriage D extending longitudinally in the middle of the station II. A second center coating robot 82 is likewise disposed at the opposite corner position of the station II and diagonally across the conveyance line from the first center coating robot 81 in such a manner as juxtaposing the vehicle body W carried over by the carriage D being conveyed on the conveyance line. The first and second center coating robots 81 and 82, respectively, are arranged each so as to spray the paint on one quarter area or quadrant of an intermediate portion of the vehicle body W, said intermediate portion being separated into four areas as divided into quadrants by the intersection of the X-axis extending perpendicular to the longitudinal direction of the vehicle body W and the Y-axis extending parallel to the longitudinal direction thereof. A subsequent description on the same and related expressions should be read with reference to this definition.

As shown specifically in FIG. 29 as an example, the first center coating robot 81 is arranged so as to spray the paint on a first quarter area or quadrant a1, as hatched in the figure, at the forward right-hand section of the intermediate portion of the vehicle body W, and the second center coating robot 82 is arranged so as to spray it on a second quarter area or quadrant a2, as hatched in the figure, at the rearward left-hand section thereof diagonal of the first quarter area a1.

A first corner coating robot 83 is disposed at the other corner position of the station II in a line with and forward of the second center coating robot 82 and facing the first center coating robot 81 across the conveyance line. A second corner coating robot 84 is disposed at the remaining corner position diagonal across the conveyance line to the opposite corner position thereof and in a line with the first center coating robot 81 and facing the second center coating robot 82. The first and second corner coating robots 83 and 84 are arranged so as to coat one half area of forward and rearward portions of the vehicle body W, respectively. The first corner coating robot 83 is to spray the paint on one half area c1, as hatched in the figure, at the left-hand position of a forward portion of the vehicle body W forward of the intermediate portion thereof, and the second corner coating robot 84 is to spray the paint on one half area c2, as hatched therein, at the right-hand position of a rearward position of the vehicle body W rearward of the intermediate portion thereof.

Station III

The station III is a second-stage coating station for interior coating and is to coat the remainder of the vehicle body W conveyed from the station II. As shown specifically in FIG. 29, the third center coating robot 85 is arranged at an intermediate position of the station III in a line with the second center coating robot 82 disposed in the station II so as to spray the paint on a forward left-hand quarter area a3, as hatched in the figure, of the intermediate portion of the vehicle body W, on the one hand. The fourth center coating robot 86 is arranged at the rearward right-hand corner position in a line with the first center coating robot 81 disposed in the station II such that it sprays the paint on a rearward right-hand quarter a4, as hatched therein, of the intermediate portion thereof, on the other hand.

As shown in FIG. 29, third and fourth corner coating robots 87 and 88, respectively, are likewise disposed at the opposite corner positions of the station III across the conveyance line of the carriage D. The third corner coating robot 87 is arranged at the forward right-hand corner position thereof in a line with the fourth center coating robot 86 so as to spray the paint on a forward right-hand half area c3 of the forward portion forward of the intermediate portion of the vehicle body W. The fourth corner coating robot 88 is arranged at the rearward left-hand corner position thereof diagonal from the third corner coating robot 87 across the conveyance line thereof such that it sprays the paint on a rearward left-hand half area c4 of the rearward portion rearward of the intermediate portion thereof.

The stations II and III are disposed to subject doors 91, 92, the engine room 93, and the trunk room 94 to interior coating. The robots 81, 82, 85 and 86 are provided with door opening or closing means (not shown).

The arrangement for the center and corner coating robots in the stations II and III permits coating by efficiently spraying the paints on the inside of the vehicle body W without interfering in movement with each other.

Station IV

In this station IV, the vehicle body W conveyed from the station III is transferred to a continuous conveyance system from the tact conveyance system. In this station, the vehicle body W is subjected to a so-called correction coating by manual operation. This correction coating is effected mainly on boundary areas between inner and outer portions of the body. The touch-up jigs 80 are withdrawn in this station and lock jigs (not shown) are mounted to lock and fix doors 91 and 92, the bonnet 95 and the boot lid 96 in order to cause them not to open as the vehicle body W is turned about the horizontal axis in the subsequent step.

Station V

This station is provided to effect exterior coating of the vehicle body W. In this station, a top surface and side surfaces are sprayed with the paint. The paint is sprayed in two installments using an automatic coater of the fixed type or of the reciprocating type. This station is to share the spraying of the paint in the first installment and the paint is sprayed in an amount less than its sagging threshold value, viz., in such an amount as forming a sufficiently thin film without causing any sags.

Station VI

This station is to make an expected correction by manual coating. The expected correction is made to manually spray the paint in advance on expected portions where a correction would be required after exterior coating in the subsequent stations VII and VIII. This expected correction helps convey the vehicle body W as quick as possible to the following setting step after spraying the paint to a film thickness thicker than its sagging threshold value in the station VII and VIII. It may be possible to carry out this correction coating prior to the station V.

Station VII

This station is to effect exterior coating on the outer surfaces other than the top and side surfaces of the vehicle body W. The coating in this station is made using coating robots 100 and 101 which are disposed at the opposite sides of the coating line so as to juxtapose the vehicle body W to be coated. The coating on these portions is made once so that the paint is sprayed in an amount larger than its sagging threshold value.

Station VIII

The station VIII is to effect the second coating on the top and side surfaces of the vehicle body W. Spraying the paint in the second installment is effected in substantially the same manner as in the station V using automatic coating machines. The paint is sprayed here to become larger than its sagging threshold value.

The automatic coating in the stations V and VIII may be preferably carried out while turning the vehicle body W in order to minimize the number of coating guns. By rotating the vehicle body about its horizontal axis, the coating can be effected by spraying the paint thereon from the coating guns in one direction because the rotation permits automatical changes of the surfaces of the vehicle body to be coated.

Figure 23:
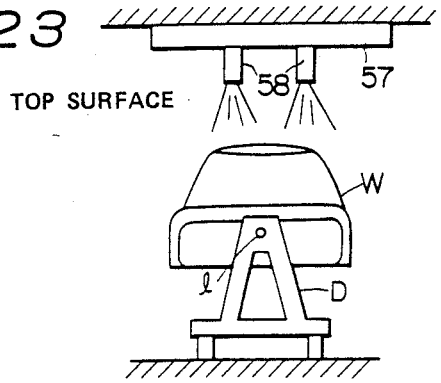
FIGS. 23 to 25 are front elevational views illustrating examples of coating the top surface and the side surfaces of the vehicle body.
Figure 24:
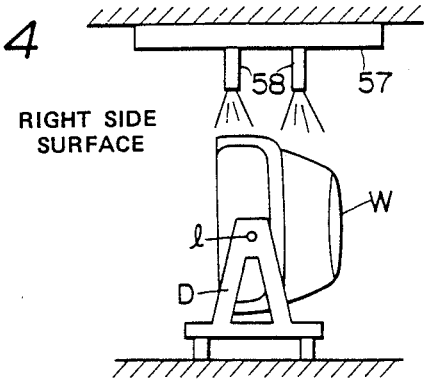

Referring now to FIGS. 23 to 25, there is shown an example of spraying the paint from the upper position only. In this case, a mounting bar 57 is fixed on the ceiling of a coating booth and plural coating guns 58 are mounted on the mounting bar 57. The coating guns 58 are disposed by their nozzles or openings facing downwardly the vehicle body W. This arrangement permits coating the top and side surfaces of the vehicle body W without changing directions of the nozzles of the coating guns 58. For instance, the vehicle body W held so as to be rotatable horizontally with its top surface directed upward by the carriage D conveyed into the coating booth is first sprayed on the top surface thereof with the paint by the coating guns 58 as shown in FIG. 23. The vehicle body W is then turned at 90° about the rotation axis l so as to allow its right side surface to face the coating guns 58 whereby the right side surface is sprayed as shown in FIG. 24. The vehicle body W is further turned at 180° about the rotation axis l and the left side surface of the body is sprayed as shown in FIG. 25.

Figure 26:
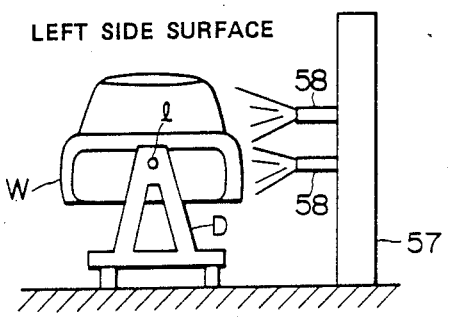
FIGS. 26 to 28 are front elevational views illustrating another examples of coating the top surface and the side surfaces of the vehicle body.
Figure 27:
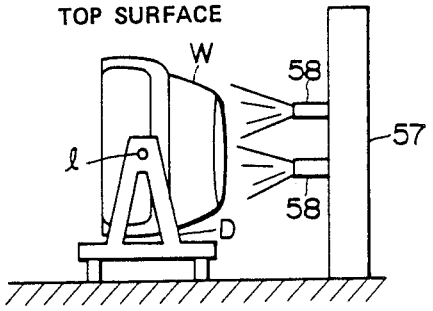
Figure 28:
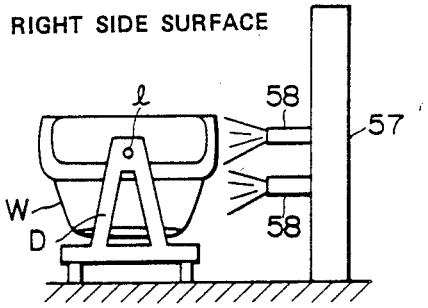

The coating guns 58 may be disposed so as to spray the paint from a transverse direction only. As shown in FIGS. 26 to 28, the coating guns 58 are mounted on the mounting bar 57 disposed on the right-hand side of the coating booth. The vehicle body W is sprayed at its left side surface with the paint as shown in FIG. 26. The vehicle body W is then turned at 90° about the rotation axis l so as to allow its top surface to be directed toward the coating guns 58 mounted at the left-hand side portion of the booth as shown in FIG. 27. After completion of the coating on the top surface, the vehicle body W is further turned at 90° and the right side surface of the vehicle body is coated as shown in FIG. 28.

It is to be understood that the present invention should be construed as being not limited to the embodiments described hereinabove and including variaties or modifications derived therefrom. The variations or modifications may include the following procedural manners as illustrative.

In removing dust from the vehicle body W in the step P1, the vehicle body W may be turned about its rotational axis l in such a series as have been shown in FIGS. 2(*a*) to 2(*i*). Dust may be removed by causing it to fall down from the vehicle body W by means of the force of gravity as the vehicle body W is rotated so as to allow its inner surfaces where dust adheres or scatters to be turned inside down. This treatment prevents the falling of dust in the setting and baking steps that follows in which the vehicle body W is caused to rotate, thereby ensuring formation of a coated surface to which no dust adheres.

Switching from the rotation of the carriage D to the suspension thereof or vice versa or changing of the rotational directions of the vehicle body W may be effected by the following procedures regardless of the running or suspending of the carriage D. As shown in FIG. 7, there may be disposed first and second pairs of chains, which correspond to the chain 34 in the figure, so as to allow them to engage each with a sprocket 33 from the opposite side in the longitudinal direction. The pairs of the chains are to be operatively driven in convenient manner. With this arrangement, the rotation of the vehicle body W may be controlled according to the following operation modes:

In the mode in which both the first chains are suspended while the second chains are released free, the vehicle body W is allowed to rotate in one direction as the carriage D runs.

In the mode in which both the first and second chains are suspended, the vehicle body W is allowed to rotate in the direction opposite to that in the above mode as the carriage D runs.

In the mode where both the first and second chains are released free, the vehicle body W is not allowed to rotate in either direction as the carriage D runs.

In the mode in which the first chains are driven in one direction and the second chains are released free, the vehicle body W is allowed to rotate in one direction as the carriage D caused to stop.

In the mode in which the first chains are driven in the opposite direction and the second ones are released free or where the first chains are released free and the second ones are driven in one direction, the vehicle body W is allowed to rotate in the direction opposite to that in the mode as described immediately hereinabove, as the carriage D is suspended.

In the above case, a rack bar may be used in place of the chains. In instances where the rack bars are disposed always in a fixed state, they may be arranged at a constantly or arbitrarily spaced relationship. With this arrangement for the rack bars, the vehicle body W may be allowed to rotate in arbitrary directions according to the position at which the carriage D runs or the rotation of the vehicle body W may be suspended at arbitrary positions.

The rotation of the vehicle body W may be carried out only in the baking step of the drying procedures.

In the case that a two-liquid setting paint is employed in the steps P3 and P10, sagging is caused in the setting steps P5 and P12 in the drying procedures so that, in this case, the rotation of the vehicle body W may be appropriately carried out in the setting steps only. In the case that a powder paint is used therein, no setting steps are required so that the vehicle body W may be conveniently rotated in the baking steps alone.

As the substrate, there may be used any material other than the vehicle bodies.

It is to be understood that the foregoing text and drawings relate to embodiments of the invention given by way of example but not limitation. Various other embodiments and variants are possible within the spirit and scope of the invention.

What is claimed is:

1. A coating method for coating a vehicle body in a coating line, comprising:

a first step of spraying an intercoating paint containing a volatilizable solvent over a surface of an undercoated vehicle body to form an intercoat layer thereon, wherein the intercoating paint is sprayed so that the intercoat layer has a film thickness which is greater than a thickness at which intercoating paint sags at least on a surface of the undercoated vehicle body extending in a substantially vertical direction;

a second step of drying the intercoat layer formed in the first step, the second step comprising sequential setting and baking steps wherein the vehicle body is held at a first ambient temperature during the setting step and a second ambient temperature during the baking step, wherein the first ambient temperature is lower than the second ambient temperature, wherein the vehicle body is rotated about its substantially horizontal axis, and wherein the rotation of the vehicle body is carried out at least in the setting step at a speed which is high enough to rotate the body before the paint coated thereon substantially sags due to gravity yet which is low enough so as to cause no sagging as a result of centrifugal force;

a third step of spraying an overcoating paint over said intercoat layer to form an overcoat layer; and a fourth step of drying said overcoat layer.

2. A coating method as claimed in claim 1, wherein said third step is conducted without wet rubbing after said second step.

3. A coating method as claimed in claim 1, wherein the intercoating paint is of a color identical or similar to that of the overcoating paint and wherein the intercoating paint is sprayed to a thickness larger than the thickness to which the overcoating paint is sprayed in the third step.

4. A coating method as claimed in claim 1, wherein correction coating is effected using the intercoating paint prior to said first step.

5. A coating method as claimed in claim 1, wherein the vehicle body is changed from one conveyance means to another between said first and second steps.

6. A coating method as claimed in claim 1, wherein the vehicle body is rotated about its horizontal and longitudinal axis to change which surface of the vehicle body to be coated faces a coater means.

7. A coating method as claimed in claim 1, further comprising a step for removing dust prior to said first step in which the vehicle body is rotated about its horizontal and longitudinal axis so as to turn it upside down.

8. A coating method as claimed in claim 1, wherein said intercoating paint is a thermosetting paint.

9. A coating method as claimed in claim 3, wherein said intercoating and overcoating paints are thermosetting paints, and wherein a combined film thickness of the intercoat layer and the overcoat layer is in the range of 70 to 100 μm.

10. A coating method as claimed in claim 3, wherein said intercoating paint is a thermosetting paint and wherein a film thickness of said intercoat layer is larger than approximately 50 μm.

11. A coating method as claimed in claim 10, wherein a film thickness of said intercoat layer is larger than approximately 60 μm.

12. A coating method as claimed in claim 3, wherein said overcoating paint is a thermosetting paint and wherein a film thickness of said overcoat layer is less than approximately 30 μm.

13. A coating method as claimed in claim 12, wherein a film thickness of said overcoat layer is in the range of 20 to 25 μm.

14. A coating method as claimed in claim 3, wherein said intercoating and overcoating paints are thermosetting paints, wherein a film thickness of said intercoat layer is larger than approximately 60 μm, and wherein a film thickness of said overcoat layer is in the range of 20 to 25 μm.

15. A coating method as claimed in claim 1, wherein said overcoating paint has a sagging threshold value which is less than that of said intercoating paint.

16. A coating method as claimed in claim 1, wherein the vehicle body is changed from one conveyance means to another between said third and fourth steps.

17. A coating method as claimed in claim 1, further comprising a step for removing dust between said second and third steps, in which the vehicle body is rotated about its horizontal and longitudinal axis so as to turn it upside down.

18. A coating method in a coating line for coating a vehicle body, comprising:

a first step of spraying an intercoating paint containing a volatilizable solvent over a surface of an undercoated vehicle body to form an intercoat layer thereon, wherein the intercoating paint is sprayed so that the intercoat layer has a film thickness which is greater than a thickness at which the intercoating paint sags at least on a surface of the undercoated vehicle body extending in substantially vertical direction;

a second step of drying the intercoat layer in the first step, the second step comprising sequential first setting and first baking steps wherein the vehicle body is held at a first ambient temperature during the first setting step and a second ambient temperature during the first baking step, wherein the first ambient temperature is lower than the second ambient temperature, wherein the vehicle body is rotated about its substantially horizontal axis, and wherein the rotation of the vehicle body is carried out at least in the first setting step at a speed which is high enough to rotate the body before the paint coated thereon substantially sags due to gravity yet which is low enough so as to cause no sagging as a result of centrifugal force;

a third step of spraying an overcoating paint containing a volatilizable solvent over a surface of the intercoat layer dried in the second step to form an overcoat layer thereon, wherein the overcoating paint is sprayed so that the overcoat layer has a film thickness which is greater than a thickness at which the overcoating paint sags at least on a surface of the intercoat layer extending in a substantially vertical direction; and a fourth step of drying the overcoat layer formed in the third step, which comprises sequential second setting and second baking steps wherein the vehicle body is held at a third ambient temperature during the second setting step and a fourth ambient temperature during the second baking step, wherein the third ambient temperature is lower than the fourth ambient temperature, the second setting step being carried out at an ambient temperature lower than the ambient temperature during the second baking step, wherein the vehicle body is rotated about its substantially horizontal axis, and wherein the rotation of the body is carried out at least in the second setting step at a speed which is high enough to rotate the vehicle body before the paint coated thereon sags due to gravity yet which is low enough so as to cause no sagging as a result of centrifugal force.

19. A coating method as claimed in claim 18, wherein correction coating is effected using the overcoating paint prior to said third step.

20. A coating method as claimed in claim 18, wherein the vehicle body is changed from one conveyance means to another between said third and fourth steps.

21. A coating method as claimed in claim 18, wherein the vehicle body is rotated about its horizontal and longitudinal axis to change which surface of the vehicle body to be coated faces a coater means.

22. A coating method as claimed in claim 18, further comprising a step for removing dust between said second and third steps, in which the vehicle body is rotated about its horizontal and longitudinal axis so as to turn it upside down.

23. A coating method as claimed in claim 18, wherein said overcoating paint is a thermosetting paint.

24. A coating method as claimed in claim 18, wherein said overcoating paint has a sagging threshold value which is less than that of said intercoating paint.

25. A coating method as claimed in claim 18, wherein said third step is conducted without wet rubbing after said second step.

26. A coating method as claimed in claim 18, wherein the vehicle body is changed from one conveyance means to another between said first and second steps.

27. A coating method as claimed in claim 18, further comprising a step for removing dust prior to said first step in which the vehicle body is rotated about its horizontal and longitudinal axis so as to turn it upside down.

28. A coating method as claimed in claim 18, wherein the intercoating paint is a two-liquid setting paint.

29. A coating method as claimed in claim 18, wherein the intercoating paint is of a color identical or similar to that of the overcoating paint and wherein the intercoating paint is sprayed to a thickness larger than the thickness to which the overcoating paint is sprayed in the third step.

30. A coating method as claimed in claim 1, wherein:

the overcoating paint to be used in the third step is a powder paint;

the third step comprises spraying the overcoating paint over a surface of the intercoat layer dried in the second step to form an overcoat layer thereon, wherein the overcoating paint is sprayed so that the overcoat layer has a thickness which is greater than a thickness at which the overcoating paint sags at least on a surface of the intercoat layer extending in a substantially vertical direction; and the fourth step comprises a baking step alone, in which the body is rotated about its substantially horizontal axis at a speed which is high enough to rotate the body before the paint coated thereon substantially sags due to gravity yet which is low enough so as to cause no sagging as a result of centrifugal force.

31. A coating method as claimed in claim 1, wherein the intercoating paint is a two-liquid setting paint.

32. A coating method for coating a vehicle body in a coating line, comprising:

a first step of spraying an intercoating paint over a surface of an undercoated vehicle body to form an intercoat layer thereon, the intercoating paint becoming flowable due to application of heat above a given temperature, wherein the intercoating paint is sprayed so that the intercoat layer has a film thickness which is greater than a thickness at which intercoating paint sags at least on a surface of the undercoated vehicle body extending in a substantially vertical direction;

a second step of drying the intercoat layer formed in the first step, said second step comprising at least a baking step, in which the heat above the given temperature is applied to the intercoat layer during the baking step and in which the vehicle body is rotated about its substantially horizontal axis at a speed which is high enough to rotate the body before the paint coated thereon substantially sags due to gravity yet which is low enough so as to cause no sagging as a result of centrifugal force;

a third step of spraying an overcoating paint over said intercoat layer to form an overcoat layer; and a fourth step of drying said overcoat layer.

33. A coating method as claimed in claim 32, wherein the second step comprises setting and baking steps, in each of which the rotation of the vehicle body is carried out about its substantially horizontal axis at a speed which is high enough to rotate the body before the paint coated thereon substantially sags due to gravity yet which is low enough so as to cause no sagging as a result of centrifugal force.

34. A coating method as claimed in claim 33, wherein said intercoating paint is a thermosetting paint.

35. A coating method as claimed in claim 32, wherein the second step comprises the baking step alone.

36. A coating method as claimed in claim 32 wherein said third step is conducted without wet rubbing after said second step.

37. A coating method as claimed in claim 32, wherein the intercoating paint is a powder paint.

38. A coating method as claimed in claim 32, wherein said overcoating paint in said third step is sprayed so that at least on a surface of the vehicle body extending in a substantially vertical direction the overcoat layer has a thickness which is greater than a thickness at which the overcoating paint sags, and wherein the vehicle body is rotated in said fourth step about its horizontal and longitudinal axis.

39. A coating method as claimed in claim 32, wherein correction coating is effected using the intercoating paint prior to said first step.

40. A coating method as claimed in claim 32, wherein the vehicle body is changed from one conveyance means to another between said first and second steps.

41. A coating method as claimed in claim 32, wherein the vehicle body is rotated about its horizontal and longitudinal axis to change which surface of the vehicle body to be coated faces a coater means.

42. A coating method as claimed in claim 32, further comprising a step for removing dust prior to said first step, in which the vehicle body is rotated about its horizontal and longitudinal axis so as to turn it upside down.

43. A coating method as claimed in claim 32, wherein said overcoating paint has a sagging threshold value which is less than that of said intercoating paint.

44. A coating method as claimed in claim 32, wherein the intercoating paint is of a color identical or similar to that of the overcoating paint and wherein the intercoating paint is sprayed to a thickness larger than the thickness to which the overcoating paint is sprayed in the third step.

45. A coating method in a coating line for coating a vehicle body, comprising:

a first step of spraying an intercoating paint over a surface of an undercoated vehicle body to form an intercoat layer thereon, the intercoating paint becoming flowable due to application of heat above a given temperature during a baking step for the intercoat layer, wherein the intercoating paint is sprayed so that the intercoat layer has a film thickness which is greater than a thickness at which intercoating paint sags at least on a surface of the undercoated vehicle body extending in a substantially vertical direction;

a second step of drying the intercoat layer formed in the first step, the second step comprising at least a baking step, in which the heat above the given temperature is applied to the intercoat layer during the baking step and in which the vehicle body is rotated about its substantially horizontal axis at a speed which is high enough to rotate the body before the paint coated thereon substantially sags due to gravity yet which is low enough so as to cause no sagging as a result of centrifugal force;

a third step of spraying an overcoating paint over a surface of the intercoat layer dried in the second step to form an overcoat layer thereon, the overcoating paint becoming flowable due to application of heat above a given temperature during a baking step for the overcoat layer, wherein the overcoating paint is sprayed so that the overcoat layer has a film thickness which is greater than a thickness at which the overcoating paint sags at least on a surface of the intercoat layer extending in a substantially vertical direction; and a fourth step of drying the overcoat layer formed in the third step, the fourth step comprising at least a baking step, wherein the heat above the given temperature is applied to the overcoat layer during the baking step and wherein the vehicle body is rotated about its substantially horizontal axis at a speed which is high enough to rotate the body before the paint coated thereon substantially sags due to gravity yet which is low enough so as to cause no sagging as a result of centrifugal force.

46. A coating method as claimed in claim 45, wherein the second step comprises setting and baking steps, in each of which the rotation of the vehicle body is carried out about its substantially horizontal axis at a speed which is high enough to rotate the body before the paint coated thereon substantially sags due to gravity yet which is low enough so as to cause no sagging as a result of centrifugal force.

47. A coating method as claimed in claim 46, wherein said intercoating paint is a thermosetting paint.

48. A coating method as claimed in claim 45, wherein the second step comprises the baking step alone.

49. A coating method as claimed in claim 45, wherein the fourth step comprises setting and baking steps, in each of which the rotation of the vehicle body is carried out about its substantially horizontal axis at a speed which is high enough to rotate the body before the paint coated thereon substantially sags due to gravity yet which is low enough so as to cause no sagging as a result of centrifugal force.

50. A coating method as claimed in claim 49, wherein said overcoating paint is a thermosetting paint.

51. A coating method as claimed in claim 45, wherein the fourth step comprises the baking step alone.

52. A coating method as claimed in claim 45, further comprising a step for removing dust prior to said first step in which the vehicle body is rotated about its horizontal and longitudinal axis so as to turn it upside down.

53. A coating method as claimed in claim 45, wherein the vehicle body is changed from one conveyance means to another between said third and fourth steps.

54. A coating method as claimed in claim 45, further comprising a step for removing dust between said second and third steps, in which the vehicle body is rotated about its horizontal and longitudinal axis so as to turn it upside down.

55. A coating method as claimed in claim 45, wherein said overcoating paint has a sagging threshold value which is less than that of said intercoating paint.

56. A coating method as claimed in claim 45, wherein said third step is conducted without wet rubbing after said second step.

57. A coating method as claimed in claim 45, wherein the vehicle body is changed from one conveyance means to another between said first and second steps.

58. A coating method as claimed in claim 45, wherein said intercoating paint and said overcoating paint are powder paints.

59. A coating method as claimed in claim 45, wherein the intercoating paint is of a color identical or similar to that of the overcoating paint and wherein the intercoating paint is sprayed to a thickness larger than the thickness to which the overcoating paint is sprayed in the third step.

* * * * *